United States Patent [19]

Borrell et al.

[11] Patent Number: 5,051,110

[45] Date of Patent: Sep. 24, 1991

[54] FIBROUS MATERIAL

[75] Inventors: Peter Borrell, Nuneaton; Timothy J. Ollerenshaw, Coventry, both of United Kingdom

[73] Assignee: Courtaulds PLC, United Kingdom

[21] Appl. No.: 515,109

[22] Filed: Apr. 27, 1990

[30] Foreign Application Priority Data

Apr. 27, 1989 [GB] United Kingdom ..... 8909627

[51] Int. Cl.[5] ..... D06M 11/00

[52] U.S. Cl. ..... 8/115.66; 8/115.59; 252/601; 252/608

[58] Field of Search ..... 252/608, 601; 8/115.66, 8/115.59

[56] References Cited

U.S. PATENT DOCUMENTS

| | | | |
|---|---|---|---|
| 2,668,096 | 4/1952 | Reeves et al. | 8/115.5 |
| 2,701,244 | 2/1955 | Ham | 260/85.5 |
| 3,906,136 | 9/1975 | Weil | 428/262 |
| 4,076,870 | 2/1978 | Yamamoto | 427/390 |
| 4,169,184 | 9/1979 | Pufahl | 428/337 |
| 4,225,481 | 9/1980 | Wagner | 260/33.2 R |
| 4,276,107 | 6/1981 | Putahl | 156/238 |
| 4,452,849 | 6/1984 | Nachbur et al. | 428/264 |
| 4,487,800 | 12/1984 | Nachbur et al. | 428/264 |

FOREIGN PATENT DOCUMENTS

| | | |
|---|---|---|
| 333235 | 11/1976 | Austria . |
| 148295 | 9/1984 | European Pat. Off. . |
| 286597 | 5/1988 | European Pat. Off. . |
| 1694233 | 7/1971 | Fed. Rep. of Germany . |
| 4812478 | 4/1973 | Japan . |
| 54064546 | 11/1977 | Japan . |
| 61-86521 | 8/1986 | Japan . |
| 1436528 | 4/1974 | United Kingdom . |
| 1372656 | 11/1974 | United Kingdom . |
| 1593184 | 9/1977 | United Kingdom . |
| 1496009 | 12/1977 | United Kingdom . |
| 2027436 | 7/1979 | United Kingdom . |

OTHER PUBLICATIONS

Derwent Accession No. 73-24032U; Questel Telesystems (WPIL); Derwent Publications Ltd., London, Abstract No. JP-A-73-012 470 (Asahi Chemical Ind. Co. Ltd.)

*Primary Examiner*—Robert L. Stoll
*Assistant Examiner*—Nina Bhat
*Attorney, Agent, or Firm*—Howson and Howson

[57] ABSTRACT

Flame-retardant fibrous material is prepared by reacting acrylonitrile polymer fibrous material with a guanidine compound of the formula

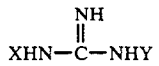

where X and Y each represent hydrogen or an amine group, or a salt thereof, in a substantially water-free polar organic solvent in which the guanidine compound is soluble. The fiber produced incorporates both repeating diaminotriazine rings of the general formula

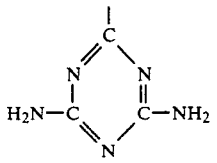

dependent from the nitrile groups of the polymer chain and repeating groups of the general formula

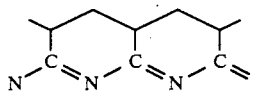

formed by cyclization of the polymer chain. The fibers can be rendered electrically conductive and used to form woven, non-woven or knitted fabrics.

16 Claims, No Drawings

FIBROUS MATERIAL

FIELD OF THE INVENTION

This invention relates to flame-retardant fibrous material.

Various types of flame-retardant fibrous materials are known, ranging from highly flame-retardant inorganic fibers, through organic fibers which have their polymer structure modified to a flame-retardant form, to organic fibers to which a flame-retardant additive has been added, either by incorporating the additive in the spinning dope for synthetic fibers or by treatment of the fibrous material in fiber or fabric form. In general, the more highly flame-retardant fibers have not been suitable for use in textile apparel. The materials incorporating a flame-retardant additive generally have a lower flame-retardance than inherently flame-retardant materials and also have the risk that the flame-retardant additive will gradually be removed by washing. There is a need for inherently flame-retardant fibrous materials, that is materials which are flame-retardant because of their polymer structure, which can resist fiber breakage during textile processing and are readily dyeable so that they can be used in textile apparel.

DESCRIPTION OF RELATED ART

GB-A-1593184 describes a method of making a flame-resistant fibrous material having at least one pendent diaminotriazine ring, which comprises immersing a fibrous material of a nitrile polymer in a basic solution of cyanoguanidine.

SUMMARY OF THE INVENTION

A process according to the present invention for the preparation of a flame-retardant fibrous material from a fibrous material comprising an acrylonitrile polymer is characterised in that the acrylonitrile polymer fibrous material is reacted with a guanidine compound of the formula

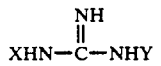

where X and Y each represent hydrogen or an amine group, or a salt thereof, in a substantially water-free polar organic solvent in which the guanidine compound is soluble.

The present invention also provides a flame-retardant fiber based on an acrylonitrile polymer, characterised in that the fiber incorporates both repeating diaminotriazine rings of the general formula

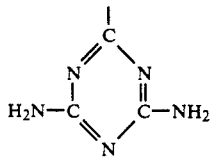

dependent from the nitrile groups of the polymer chain, and repeating groups of the general formula

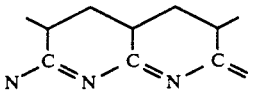

formed by cyclisation of the polymer chain.

Carrying out the reaction between the acrylonitrile polymer and the guanidine compound in the absence of water enables the reaction to proceed to the extent of forming both the diaminotriazine rings and the cyclised nitrile groups.

DETAILED DISCLOSURE

The acrylonitrile polymer contains at least 50% by weight acrylonitrile or methacrylonitrile units, preferably at least 85% by weight acrylonitrile units, for example it may be a copolymer of 85 to 95% by weight acrylonitrile, up to 3% by weight of a monomer conferring dyeability, for example an acidic monomer such as an unsaturated carboxylic or sulphonic acid or a basic monomer such as vinyl pyridine, and 3 to 13% by weight of another comonomer, such as methyl acrylate, vinyl acetate or a chloromonomer, such as vinylidene chloride or vinyl chloride. The acrylonitrile polymer can be spun into fibers by dry-spinning, for example from dimethyl formamide or ethylene carbonate, or by wet-spinning, for example from dimethyl acetamide into aqueous acetamide or from a concentrated to a dilute aqueous sodium thiocyanate solution or zinc chloride solution.

The guanidine compound is preferably guanidine itself, although amino-guanidine and diamino-guanidine are alternatives. The guanidine compound can be used in free base form, but guanidine is generally supplied commercially in salt form and salts of weak acids, for example guanidine carbonate, are preferred. The guanidine salt should preferably be sufficiently basic such that when dissolved in water it would give a pH over 7, although in use it is not dissolved in water. Salts of strong acids such as the hydrochloride or sulphate can be used, but preferably with a base such as sodium carbonate or excess guanidine. Guanidine carbonate has the advantage of being less liable to decompose at reaction temperatures than guanidine while being more reactive than guanidine salts of strong acids. Moreover there is no build-up of salt in the reactor since carbon dioxide is evolved and escapes during the reaction.

The solvent for the guanidine is preferably a glycol, most preferably ethylene glycol. Ethylene glycol has the advantages that it dissolves substantially all the guanidine compounds and their salts, is easy to handle, has a high flashpoint, a high boiling point, and a low vapour pressure at ambient temperature, and is water-miscible and biodegradable for easier recovery and disposal. Propylene glycol, triethylene glycol, diethylene glycol, tetraethylene glycol and dipropylene glycol are alternatives. Alternative solvents are alcohols such as cyclohexanol (lower alcohols may need to be used under pressure) and ether and ester alcohols and glycol ethers and esters, for example ethoxyethanol, 2-methoxyethyl acetate, 2-ethoxyethyl acetate or hydroxyethyl acetate. The concentration of guanidine compound in the solvent is preferably 0.5 to 25% by weight, more preferably 1 to 5% and particularly 1.5 to 3.5% by weight. The fibrous material generally increases in weight by 8 to 20% as a result of the guanidine treatment. The solvent should be substantially water-free to avoid hydrolysis of the fiber and preferably contains less than 3% by weight of water. If an aqueous solution of guanidine is used, treatment of fibers at room temperature will give impregnation but no reaction. If the aqueous solution is used at an elevated temperature, hydrolysis of the fibers occurs with the addition of carboxyl groups, which results in shrinkage and dissolution of the fibers.

Although 3% is an effective top limit for the water content of the solvent, the water level is preferably kept below 2%, as the fibers start becoming rubbery at 2% water content, and start to become unusable at a water content of about 3%. The water contents refer to the level of water in the solvent prior to treatment, as the water, if present, is consumed during treatment to give an equilibrium level of about 0.5% to 0.7% water in the recycled glycol.

The fact that, when present, moisture may play a part in the reaction forming the flame-retardant fiber is an indication of the complexity of reactions occurring in the fiber production. Other reactions appear to occur, such as the formation of alternative guanidinamidine groupings, i.e. a reaction of guanidine onto the pendent nitrogen of the base acrylonitrile chain as follows

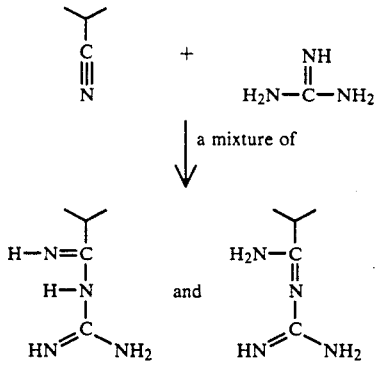

These compounds can then react with further guanidine to form the diaminotriazine ring.

It is also possible that partial cross-linking is occurring because the fiber of the invention is very insoluble in such active solvents as sodium thiocyanate (NaSCN), dimethylformamide, dimethylsulphoxide and propylene carbonate/ethylene carbonate mixtures.

The temperature of treatment is preferably in the range 100° to 200° C., most preferably 130° to 160° C. The time of contact between the fibrous material and the guanidine compound is preferably in the range 5 minutes to 10 hours.

The fibrous material treated can for example be a tow, staple fiber, spun yarn or woven, knitted or non-woven fabric. Staple fiber can for example be treated as loose-packed cut staple in apparatus used for package dyeing, for example Pegg dyeing machinery. The fiber to liquor ratio will depend on the apparatus used but can for example be 1:5 to 1:40, by weight. Lengths of tow can be treated in similar apparatus. Using a short treatment time, for example 15 minutes or less, combined with a relatively high temperature and high concentration of guanidine compound in the solvent, a tow can be treated continuously.

As mentioned above, the guanidine treatment causes cyclisation of the nitrile groups, forming polyimine groups of the formula

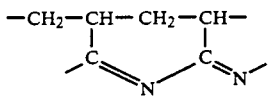

together with formation of pendent diaminotriazine groups. Some amide and carboxylate groups are also formed.

The fibrous material produced by the process of the invention generally has a limiting oxygen index (LOI) of 25 to 37, compared to an LOI of 18 for untreated acrylonitrile polymer fibers. Moreover, treated fibrous material can be produced having an LOI of at least 30 and a tenacity and extensibility sufficient to withstand conventional textile processing. For example, if acrylic fiber tow or staple, including low decitex fiber of 1 to 2 decitex, is treated with guanidine according to the invention it can be further processed by the classical cotton spinning route involving carding machinery and ring spinning to give fine yarns, and the yarns can withstand weaving and knitting. Treated staple can also be processed by the woollen or worsted route. The tenacity of treated fibers is generally 10 to 20 cN/tex and the extensibility 35 to 50%. The knot work product (product of knot tenacity and % strain) is 100 to 600% cN/tex. These properities, although lower than for conventional acrylic fibers, are higher than for known flame-retardant fibers derived from acrylic fibers.

The flame-retardant fibers of the invention can be rendered electrically conducting by providing them with an unreactive conducting layer. This can be achieved by treating the fiber, which possesses ligands with an affinity for copper (II) ions, with solutions containing copper (II) ions and a sulphur-containing compound which may be also a reducing agent. This results in the addition of CuS. An additional reducing agent optionally can be used but this is not essential to the production of a conducting, flame-retardant fiber. The modified process is believed to involve absorption of a soluble precursor into the fiber, formation of a strong, unreactive covalent bond between the precursor and the fiber and the production of an insoluble conducting phase as a layer on the surface of the fiber.

The formation of the electrically conductive layer is simple to carry out and the resulting electrically conductive fibers are stable in air.

It is believed that the copper ions bind onto one or other of the nitrogen-containing species, and the sulphur ions either bond to the copper or migrate into the body of the fiber.

Not only has it been found that the CuS addition makes the fiber conducting, it also increases the flame-retardant properties of the fiber. This is very surprising as copper ions often act as catalysts promoting oxidation. For example, a copper-containing flame-retardant fiber not in accordance with the invention continues to glow red hot after being ignited and having the flames extinguished. However, the CuS-containing fibers of the invention—particularly those formed in accordance with Example 1.5 below—do not suffer from afterglow.

The treatment with a guanidine compound according to the invention generally causes shrinkage of the fibrous material, for example by 20 to 40%. It may be advisable to take this into account, for example staple fiber can be cut longer than is usual so that after the guanidine treatment it has the desired staple length.

The treated product can be drained or squeezed free of excess solvent and water-washed to remove remaining water-miscible solvent. The solvent is generally recovered, for example for re-use in the treatment process. Washing can be carried out in two or more stages; for example fresh water can be used for the second wash, with water from the second wash stage being used in the first wash. Use of a three-stage process of this type leads to a liquor from the first wash containing 50–60% by weight glycol, which can be used in commercial glycol recovery processes.

The fibrous material produced by the treatment generally has a golden orange-yellow colour. It can optionally be decoloured by treatment with aqueous mildly alkaline sodium hydrosulphite or mildly acidic sodium metabisulphite, or to some extent by boiling water. If dark dye shades are required, decolourisation is not necessary. The fibrous material can be dyed by chrome dyes, direct dyes, basic dyes or acid dyes. The dyed fibers can optionally additionally be post-treated with an aqueous solution of a polyvalent metal compound. The chrome dyes are fixed on the fiber by a subsequent fixing treatment with a chromium compound, for example potassium dichromate, as is recommended when using these dyes. Fibers dyed with other dyes, for example with acid dyes, or ecru fibers, can for example be treated with a zinc salt such as zinc sulphate. The zinc salt can for example be applied as a 1–10% by weight solution at temperatures from ambient up to 100° C. The polyvalent metal salt treatment (either chrome fixing or treatment with a zinc salt) can increase the flame resistance of the fiber, raising the LOI by a further 2 or 3 units.

Treatment with a strong acid, for example in acid dyeing, may give protonation of the amine functions of the diaminotriazine rings and subsequent formation of salts at these positions.

The treated fibrous material of the invention is particularly suitable for use in woven or knitted apparel, for example as protective clothing, particularly protective clothing which has to be worn throughout the working day. It has a high moisture regain of 10 to 15% by weight which is similar to that of cotton, so that clothing made from the fibrous material feels comfortable. It can also be used in interlinings for protective clothing. The treated fibrous material is inherently flame-retardant (no additives which can be removed by washing) and does not rely on halogen content for its flame-retardant properties, so that it gives less smoke when burning or smouldering; this is a particular advantage for use in upholstery, especially for aircraft, train and automobile seats.

Fabrics for such uses can be formed entirely from the treated fibrous material of the invention, or they can be formed from blends with other fibers. In particular, the fibrous material of the invention can be used with flame-retardant fibers having a low moisture-regain, for example "Nomex" aramid fibers, in fiber blends for woven or knitted apparel. The material of the invention provides in one fiber both the comfort resulting from high moisture-regain and substantial flame-retardance. This combination is also provided in a fiber which can be processed into fabrics, particularly knitted or woven fabrics for apparel. It may also be formed into non-woven fabrics. The fibrous material can be used with modacrylic flame-retardant fibers, such as "Teklan" based on acrylonitrile/vinylidene chloride copolymer, to improve both the comfort and the flame-retardance of garments made from the fibers. The fibrous material can also be blended with flame-retardant viscose, cotton or wool.

Treatment with guanidine has several advantages over treatment with cyanoguanidine described in GB-A-1593184. Guanidine gives fibrous material which is of improved light-fastness and which can be more easily decoloured. Guanidine-treated fiber also gives 25% more dye uptake on dyeing. Guanidine can be applied in a shorter reaction time and using less reagent to give a fiber of equal LOI. Moreover, it releases substantially no impurities into the glycol solvent so that the solvent can be recovered and repeatedly re-used by the addition of further guanidine. By contrast, when cyanoguanidine was used in the ethylene glycol solvent, a precipitate was observed in the solvent. This precipitation resulted in an increase in the viscosity of the solution with a consequent poor heat transfer to the ethylene glycol, and this meant that it was difficult to heat the solution. The precipitate also tended to be filtered out by the fibers being treated and thus contaminated the fibers. Furthermore, the precipitate, the nature of which was not determined, was difficult to remove from the ethylene glycol and made it difficult to recycle and reuse the solvent—with attendant cost and effluent treatment problems.

The invention is illustrated by the following Examples.

EXAMPLE 1

1.1 Manufacture of flame-retardant fiber 20 kg of "Courtelle" (Registered Trade Mark) commercial acrylic fiber was packed in the annular compartment of a package dyeing machine. 180 liters of a 30 g/liter solution of guanidine carbonate in ethylene glycol was raised to and maintained at 145° C. and circulated by a pump through the perforated column around which the fiber was packed, permeating the fiber, and, thereafter, returning to the pump and heating coil. The liquor was continuously recirculated for 1.5 hours and then cooled and recovered and the fiber was drained for 15 minutes.

Demineralised water (at 20°–25° C.) was then substituted in the apparatus. The fiber was washed by circulating the water in the same way as the glycol liquor had been circulated. The washing process lasted 5 minutes and was repeated with fresh water, two more times.

1.2 Optional bleaching process on the guanidine derivative fiber

The flame-retardant fiber from the process of Example 1.1 was subjected to a 200 liter aqueous solution of 5 g/liter sodium hydrosulphite at pH 9, at 50° C. The recirculation of the liquor was continued for 15 minutes. The liquor was drained from the dyeing machine and the mass of fiber was washed by introducing water as the process liquor. The washing process lasted 5 minutes.

1.3 Optional zinc sulphate treatment of the fiber

The fiber from the process of Example 1.2 was subjected to a 180 liter aqueous solution of 50 g/liter zinc sulphate monohydrate at 30° C. The recirculation of the liquor was continued for 15 minutes. The liquor was recovered and drained from the dyeing machine and the fiber was washed by introducing water as the process liquor. The washing process lasted 5 minutes and was repeated with fresh water two more times to remove residual zinc sulphate.

1.4 Soft finish treatment of the fiber

The fiber from the process of Example 1.3 was subjected to a 180 liter aqueous solution of 5 g/liter proprietary soft finish (fiber-processing lubricant) at 75° C. The recirculation of the liquor was continued for 15 minutes. The liquor was recovered and drained from the fiber package in the dyeing machine. Fiber packed in the annular compartment was removed, centrifuged to remove excess liquor and then dried at 110° C. until hand-dry. This fiber was then over-sprayed with 0.2% by weight proprietary anti-static agent.

The fiber had an LOI of 31.4. The straight tenacity was 15.6 cN/tex, 50.2% strain, straight work product 784 and knot tenacity 10.8 cN/tex, 37.8% strain, knot work product 408.

1.5 Electrically conductive, flame-retardant fiber

The flame-retardant fiber from the process of Example 1.1 was treated with a solution consisting of 1.20 g/liter copper (II) sulphate pentahydrate and 3.56 g/liter sodium thiosulphate (with optionally 1.56 g/liter hydroxylamine sulphate) using 4 g fiber per liter of solution. The solution was heated from cold to a temperature of 80°–95° C. at a heating rate of 2° C./minute over a period of about 30 minutes, and maintained at this temperature for 120 minutes. The reaction mixture changed through amber and deep green to brown/-black. The resulting fibers were drained, washed with fresh water and then dried.

The fiber made by this process had an LOI of 34. The conductance of the fiber was $625\times10^{-3}$ Siemens (1.4 ohms). The conductive copper sulphide was found to be distributed in a continuous layer covering the surface and penetrating up to 0.7 microns inside the fiber.

1.6 Two-stage conductive treatment

In an alternative two-step process, fibers from the process of Example 1.1 were heat treated at 90° C. for 90–120 minutes in copper (II)-containing stock solution containing 34.35 g/l copper (II) nitrate and 13.35 g/l hydroxylamine sulphate, and subsequently in reducing acidified sulphur-containing stock solution containing 13.35 g/l hydroxylamine sulphate and 50 g/l sodium sulphide for 120–180 minutes at 90° C. The modified fibers were washed and dried.

There are a number of variations on the process of Example 1.6 which can be used, including the use of alternative reducing agents which may or may not contain sulphur, such as sodium bisulphite.

EXAMPLE 2

20 kg "Courtelle" acrylic fiber was treated with guanidine carbonate according to Example 1.1 to produce fiber of LOI 27.1.

The treated fiber was subjected to a 180 liter aqueous solution of 1.05 kg Omega Chrome Brown EBC (Registered Trade Mark), and 1.8 kg sodium sulphate, adjusted to pH3 and raised to 100° C. over 30 minutes. The dyebath was maintained at 100° C. over 20 minutes, then cooled to 80° C. and the pH was readjusted to 3. Potassium dichromate (600 g) was then added as a 20 g/liter solution and the temperature was raised to and maintained at 100° C. for 20 minutes.

The liquor was cooled, then drained from the apparatus, and demineralised water was substituted. The fiber was washed by circulating the water at 40° C. The washing process lasted 5 minutes and was repeated with fresh water two more times to remove residual dye.

The dyed fiber was treated with soft finish according to Example 1.4. The LOI of the final fiber was 30.0.

EXAMPLE 3

3.1 Manufacture of flame-retardant fiber 20 g acrylic fiber was placed in a 1 liter reaction flask fitted with reflux condenser and thermometer. In a mixed solvent of 315 ml ethylene glycol and 160 ml butanol was dissolved 10.3 g guanidine hydrochloride salt and 11.1 g anhydrous sodium carbonate to liberate the free base. The mixture was heated and refluxed at 141° C. in an isomantle for 1¼ hours. After cooling the reaction mixture, the excess liquid was removed and the fiber was thoroughly washed with distilled water.

The fiber was orange in colour. Its LOI was 32.4, knot tenacity 8.31 cN/tex, strain 41.1% and knot work product 342.

3.2 Bleaching process

Portions of the fiber from Example 3.1 were subjected to either:

3.2.1 first portion: 5 g/liter sodium hydrosulphite, 100° C., 30 mins, or:

3.2.2 second portion: 0.25 g/liter sodium metabisulphite, 1 g/liter oxalic acid, 0.25 g/liter Calgon R, 100° C., 30 mins.

The resultant paler orange fibers were then washed with water.

3.3 Chrome dyeing

To fiber from Example 3.2.2, Omega Chrome Green FL dye was applied at 6% by weight of fiber from 0.2 liter aqueous solution. Dye was applied at pH 3–4 (adjusted with formic acid) with 10 g/liter sodium sulphate and raised to 100° C. over 30 mins in a steel canister in a heated bath. The pH was then checked and readjusted, then the material was heated for a further 30 minutes. The bath was cooled to 80° C. and the pH re-adjusted to 3–4. Potassium dichromate was then added equal to half the concentration of the dye and the dyeing was continued at 100° C. for a further 20 minutes. A full olive-green shade was achieved.

3.4 Zinc sulphate treatment

The fiber from Example 3.1 was subjected to a 10 g/liter aqueous solution of zinc sulphate monohydrate at 40°–50° C. for 15 minutes. Zinc complexed onto the fiber and the residue was washed off with distilled water. The LOI of the zinc-treated fiber was 36.1 and knot tenacity 9.6 cN/tex, strain 33.7% and knot work product 324.

EXAMPLE 4

20 g of acrylic fiber was placed in a 1 liter reaction flask fitted with a reflux condenser and thermometer. In a mixed solvent of 415 ml ethylene glycol and 66 ml butanol was dissolved 7.01 g aminoguanidine hydrocarbonate salt and 5.35 g anhydrous sodium carbonate to liberate free amine. The mixture was heated and refluxed at 163° C. in an isomantle for 140 mins. After cooling the reaction mixture, the excess liquor was removed and the fiber was thoroughly washed with distilled water.

The fiber was orange in colour. Its LOI was 34.6, knot tenacity 7.3 cN/tex, strain 41.4% and knot work product 301.

The fibers prepared in accordance with Examples 1.5 and 1.6 had their conductance and resistance measured using a conventional four-probe apparatus set up in accordance with method 2 of British Standard BS 2044:1984 "Determination of resistivity of conductive and antistatic plastics and rubbers (laboratory methods)".

The results are set out in Table 1.

TABLE 1

| Untreated Fiber | Example 1.5 Fiber | Example 1.6 Fiber |
|---|---|---|
| 68 mega ohm | 1.4 ohm | 1.6 ohm |

The ac impedances of the sulphided copper-loaded fibers prepared in accordance with Example 1.5 were independent of frequency (within experimental error) in the frequency range 0.01–1000 KHz. The phase angle, however, altered with frequency. A positive phase angle is indicative of inductive behaviour and a negative phase angle indicates that the sample is behaving as a capacitor. The fibers became more inductive as the ac frequency was increased, but the impedance of a particular sample remained constant except at very high frequency (1000 KHz). See the two tests reported in Table 2.

TABLE 2

| ac Impedance Measurements | | | | | |
|---|---|---|---|---|---|
| Test 1 | | | Test 2 | | |
| Experimental Frequency (KHz) | Impedance of sample Z (ohms) | Phase Angle | Experimental Frequency (KHz) | Impedance of sample Z (ohms) | Phase Angle |
| 0.01 | 0.820 | −0.2 | 0.01 | 1.102 | −0.16 |
| 0.10 | 0.814 | 0.0 | 0.10 | 1.094 | 0.0 |
| 1.0 | 0.813 | 0.1 | 1.0 | 1.094 | 0.1 |
| 10 | 0.812 | 0.7 | 10 | 1.092 | 0.6 |
| 100 | 0.820 | 5.8 | 100 | 1.101 | 4.5 |
| 1000 | 1.131 | 41.4 | | | |
| Ave* | 0.816 | | | 1.097 | |
| Sd* | $3.487 \times 10^{-3}$ | | | $4.079 \times 10^{-3}$ | |
| Length of cell | 9.58 cm | | | 9.61 cm | |
| Width of sample | 0.07 cm | | | 0.10 cm | |
| Weight of sample | 0.0345 g | | | 0.0484 g | |

Ave = mean impedance
Sd = standard deviation of impedance measurements
*Calculation does not include 1000 KHz measurement Fibre produced in accordance with Example 1.1 was processed and converted readily to yarns and fabrics. To spin the fiber, it is possible to open the fiber using only a double hopper, but a single Kirschner beater could be added if required. Carding can be carried out on either flat or roller and clearer cards and speeds up to 120 meter/minute, i.e. approximately 30 kg/hour, are achievable.

Drawing can be carried out on high-speed drawframes at 500 meters per minute. Yarns may be ring-spun from single roving on a double apron system with a total draft of 20 using a twist factor of 3.3. Spindle speeds of up to 7000 rpm may be used, and coated rings are preferred.

For commercial spinning a limit of 12's Ne is preferred as the maximum although it is possible to spin finer. Due to the fiber tenacity, a count strength product of 1200 to 1500 is to be expected and because of good yarn regularity this is adequate for both weaving and knitting.

Weaving, the most commonly used construction, is possible with the fiber of Example 1.1. Single warp yarns may be sized but two fold yarns may be woven without size. Either single-end or section warping may be used and a size such as Colvinal 226 is preferred. Knitted fabrics may be produced on V-bed, circular, and RTR or SPJ machines. Machine gauges suitable for the yarns of the invention are:-Flat Machines 12 to 5 (multiple ends with coarser gauges) Circular Machines 18 to 9 RTR or SPJ 12 and 8

It is preferable to use waxed yarn with positive feed devices where available.

Woven fabrics preferably should be desized, using a non-ionic detergent at 65° C. in neutral conditions for a size such as Colvinal 226, but enzyme treatment for starch sizes. After scouring, a soft finish may be applied and after cooling and hydroextraction the fabric should be stentered at 130° C.±5° C. at the natural cloth width. Knitted fabrics require only a low-temperature scour, using 1.0 g/l non-ionic determine and 0.1 g/l acetic acid for 15 minutes at 60° C. After rinsing, a soft finish may be applied, and after cooling and hydroextracting the fabric should be stentered at 130° C.±5° C.

The fabric produced does not melt or shrink away from flame, but decomposes to form a char. Thermal stability is good and fabrics can withstand short term exposure to 400° C. The fabric remains intact and its properties are reasonably retained. From 400° to 430° C. the fabric blackens and losses in strength and elasticity occur. Above 430° C. the fabric chars and becomes brittle. On keeping at 200° C. for 24 hours, tenacity is unaffected but extension is significantly reduced. The fibers of the invention are resistant to dilute acids, but less so to concentrated acids or alkali solutions. They show very good resistance to most organic solvents.

Abrasive resistance is good, with the following Martindale values being achieved on trial fabrics:

Woven Fabric 42,000 rubs
Single Jersey 26,000 rubs
Double Jersey 80,000 rubs

It can be seen, therefore, that the invention provides a good flame-retardant fiber which can be processed readily into fabric, which can be formed into garments and has a good comfort level accompanied by good flame retardancy properties and good abrasion and wear resistance.

What is claimed is:

1. A process for the preparation of a flame-retardant fibrous material from a fibrous material comprising an acrylonitrile polymer, comprising reacting the acrylonitrile polymer fibrous material with a guanidine compound of the formula

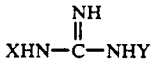

where X and Y each represent hydrogen or an amine group, or with a salt thereof, said reaction being carried out in a substantially water-free polar organic solvent in which said guanidine compound is soluble.

2. A process as claimed in claim 1 in which said polar organic solvent contains less than 3% water by weight of the solvent.

3. A process as claimed in claim 1 in which said guanidine compound is guanidine.

4. A process as claimed in claim 1 in which said guanidine compound is in the form of a salt of a weak acid.

5. A process as claimed in claim 4 in which the guanidine compound is guanidine carbonate.

6. A process as claimed in claim 1 in which said solvent is a glycol.

7. A process as claimed in claim 6 in which said glycol is ethylene glycol.

8. A process as claimed in claim 1 in which said acrylonitrile polymer fibrous material is reacted with said guanidine compound at a temperature of 100° to 200° C.

9. A process as claimed in claim 8 in which the reaction temperature is in the range 130° C. to 160° C.

10. A process as claimed in claim 1 in which said acrylonitrile polymer fibrous material after reaction with said guanidine compound is treated with an aqueous solution of a polyvalent metal compound.

11. A process as claimed in claim 10 in which said acrylonitrile polymer fibrous material is dyed by a chrome dye and fixed with a chromium compound.

12. A process as claimed in claim 10 in which said polyvalent metal compound is a zinc salt.

13. A flame-retardant fiber based on an acrylonitrile polymer and incorporating both repeating diaminotriazine rings of the general formula

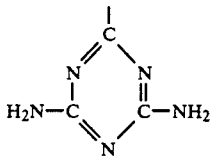

dependent from the nitrile groups of the polymer chain and repeating groups of the general formula

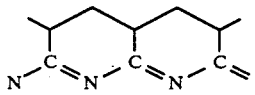

formed by cyclisation of the polymer chain.

14. A fiber as claimed in claim 13 which is rendered electrically conducting by the addition of copper sulphide.

15. A process as claimed in claim 1 in which there is provided the further step of treating the flame-retardant fibrous material with a solution containing copper (II) ions and a sulphur-containing compound.

16. A process as claimed in claim 15 in which a reducing agent is added to the copper (II)-containing solution.

* * * * *